US007568683B1

(12) United States Patent
Lovas

(10) Patent No.: US 7,568,683 B1
(45) Date of Patent: Aug. 4, 2009

(54) VISE ATTACHABLE FIXTURE PLATE FOR USE WITH CNC MILLING EQUIPMENT

(76) Inventor: Stephen R. Lovas, P.O. Box 10573, Bozeman, MT (US) 59719

( * ) Notice: Subject to any disclaimer, the term of this patent is extended or adjusted under 35 U.S.C. 154(b) by 63 days.

(21) Appl. No.: 11/810,959

(22) Filed: Jun. 7, 2007

Related U.S. Application Data

(60) Provisional application No. 60/811,694, filed on Jun. 7, 2006.

(51) Int. Cl.
*B25B 11/00* (2006.01)

(52) U.S. Cl. ..... 269/43; 269/45

(58) Field of Classification Search ..... 269/43, 269/45, 244, 279–284, 256, 134, 261, 258, 269/93
See application file for complete search history.

(56) References Cited

U.S. PATENT DOCUMENTS

| | | | | | |
|---|---|---|---|---|---|
| 4,529,183 | A | * | 7/1985 | Krason et al. | 269/43 |
| 5,242,159 | A | * | 9/1993 | Bernstein | 269/32 |
| 5,535,995 | A | * | 7/1996 | Swann et al. | 269/43 |
| 5,562,277 | A | | 10/1996 | Swann et al. | |
| 5,634,253 | A | | 6/1997 | Swann | |
| 5,653,038 | A | | 8/1997 | Hunter | |
| 5,720,476 | A | | 2/1998 | Swann et al. | |
| 5,735,514 | A | * | 4/1998 | Moore et al. | 269/43 |
| 5,762,326 | A | * | 6/1998 | Swann | 269/43 |
| 5,893,551 | A | * | 4/1999 | Cousins et al. | 269/43 |
| 5,921,534 | A | | 7/1999 | Swann et al. | |
| 5,984,290 | A | * | 11/1999 | Durfee, Jr. | 269/43 |
| 6,000,688 | A | | 12/1999 | Giangrasso | |
| 6,012,712 | A | * | 1/2000 | Bernstein | 269/43 |
| 6,253,898 | B1 | | 7/2001 | O'Brien | |
| 6,349,929 | B1 | | 2/2002 | Speltz et al. | |
| 6,422,931 | B1 | | 7/2002 | Laflamme | |
| 6,585,463 | B1 | | 7/2003 | Kaba | |
| 6,672,578 | B1 | | 1/2004 | Martens | |
| 6,773,003 | B2 | | 8/2004 | Dermody, Jr. | |
| 7,150,213 | B2 | | 12/2006 | Bautz | |
| 2003/0071404 | A1 | | 4/2003 | Cairns | |
| 2004/0250394 | A1 | | 12/2004 | Bautz | |

* cited by examiner

*Primary Examiner*—Lee D Wilson
(74) *Attorney, Agent, or Firm*—Richard C. Conover

(57) ABSTRACT

A fixture plate for use with a CNC milling machine. The fixture plate is constructed of a generally rectangular block having a top surface, a bottom surface and a forward edge. The bottom surface of the block is positioned to rest on the support surface with the forward edge of the block resting against the fixed jaw. The bottom surface of the block includes a cavity in which is mounted a clamping pin for coupling with the vise hook nut. When the machine screw is manipulated to move the mounting block toward the fixed jaw, the block is clamped to the vise between the fixed jaw and the vise hook nut. The top surface of the block is provided with grooves shaped to conform to the peripheral shape of each of the multiple workpieces. Clamping nuts, recessed in the grooves, are used for clamping the multiple workpieces to the block.

2 Claims, 11 Drawing Sheets

VISE ATTACHABLE FIXTURE PLATE FOR USE WITH CNC MILLING EQUIPMENT

This application claims the benefit of provisional application Ser. No. 60/811,694 filed Jun. 7, 2006.

BACKGROUND OF INVENTION

The present invention relates to a vise attachable fixture plate which can be used with conventional CNC milling equipment. The present invention allows users of the CNC milling equipment to machine multiple workpieces in a single setup.

When machining a workpiece on conventional computer numerically controlled ("CNC") machines the workpiece is typically held in place with a clamping member or vise. It is desirable to have the ability to mount as many workpieces at a single time to reduce the amount of machine set-up and tool-change time. An example of one such apparatus is described in U.S. Pat. No. 5,634,253 where multiple vises are mounted to the CNC machine. This apparatus is inconvenient to use and expensive to construct.

The present invention solves the problem of mounting multiple workpieces on a CNC machine by providing a fixture plate which is easily secured to the CNC machine with the vise of the CNC machine. The fixture plate is designed to hold multiple workpieces for the machining operation, thus significantly reducing set-up and tool-change time.

SUMMARY OF INVENTION

A fixture plate for use with a CNC milling machine having a support surface, a fixed jaw assembly together with a vise hook nut threadably? secured to a machine screw for moving the vise hook nut toward or away from the fixed jaw. The fixture plate is constructed of a generally rectangular block having a top surface, a bottom surface and a forward and rearward edge. The bottom surface of the block is positioned to rest on the support surface with the forward edge of the block resting against the fixed jaw. The bottom surface of the block includes a cavity in which is mounted a clamping pin for coupling with the vise hook nut whereby when the machine screw is manipulated to move the mounting block toward the fixed jaw, the block is clamped to the vise between the fixed jaw and the vise hook nut. The top surface of the block is provided with grooves shaped to conform to the peripheral shape of each of the multiple workpieces. Clamping nuts, recessed in the grooves, are used for clamping the multiple workpieces to the block.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
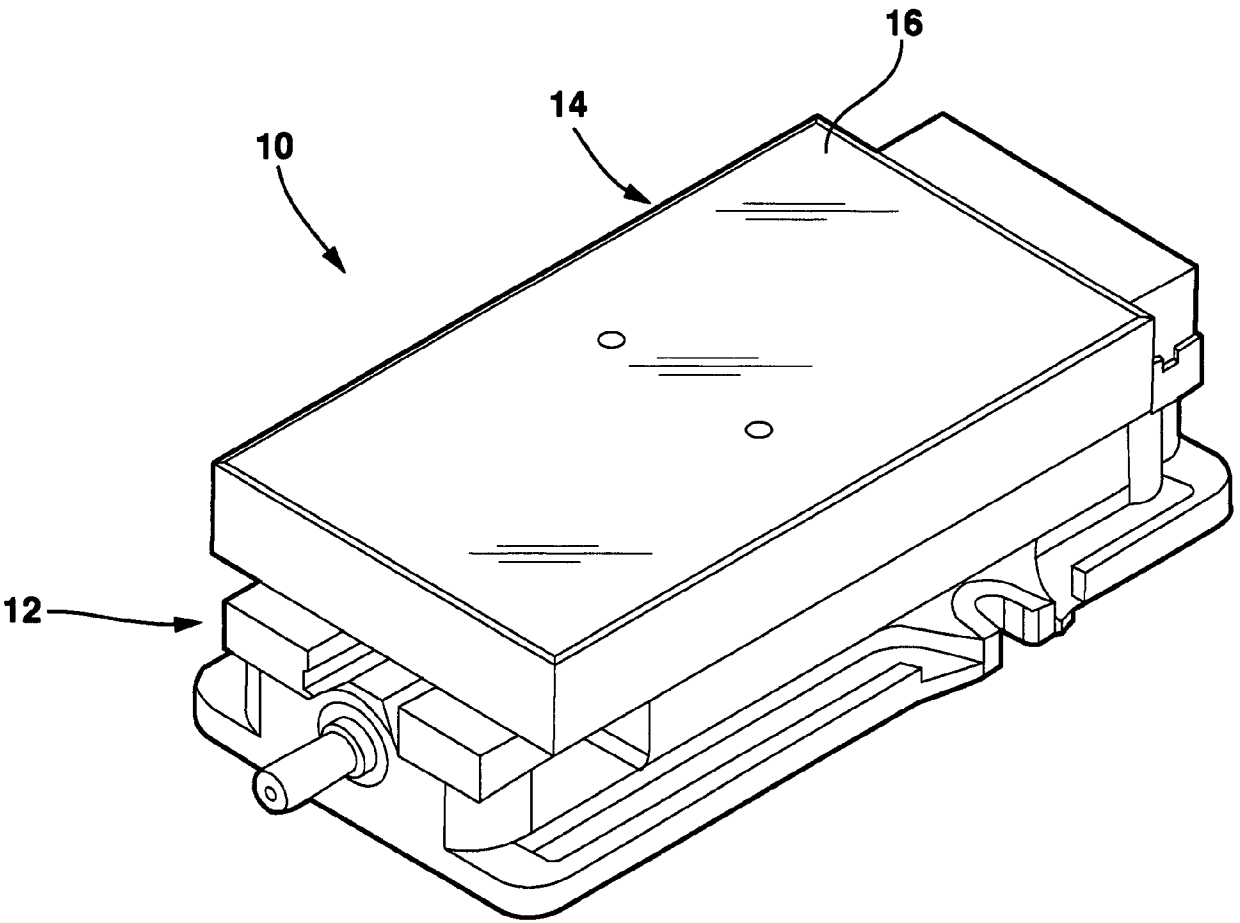
FIG. 1 is a perspective view of a fixture plate according to the present invention mounted on a vise of a conventional CNC milling machine.
Figure 2:
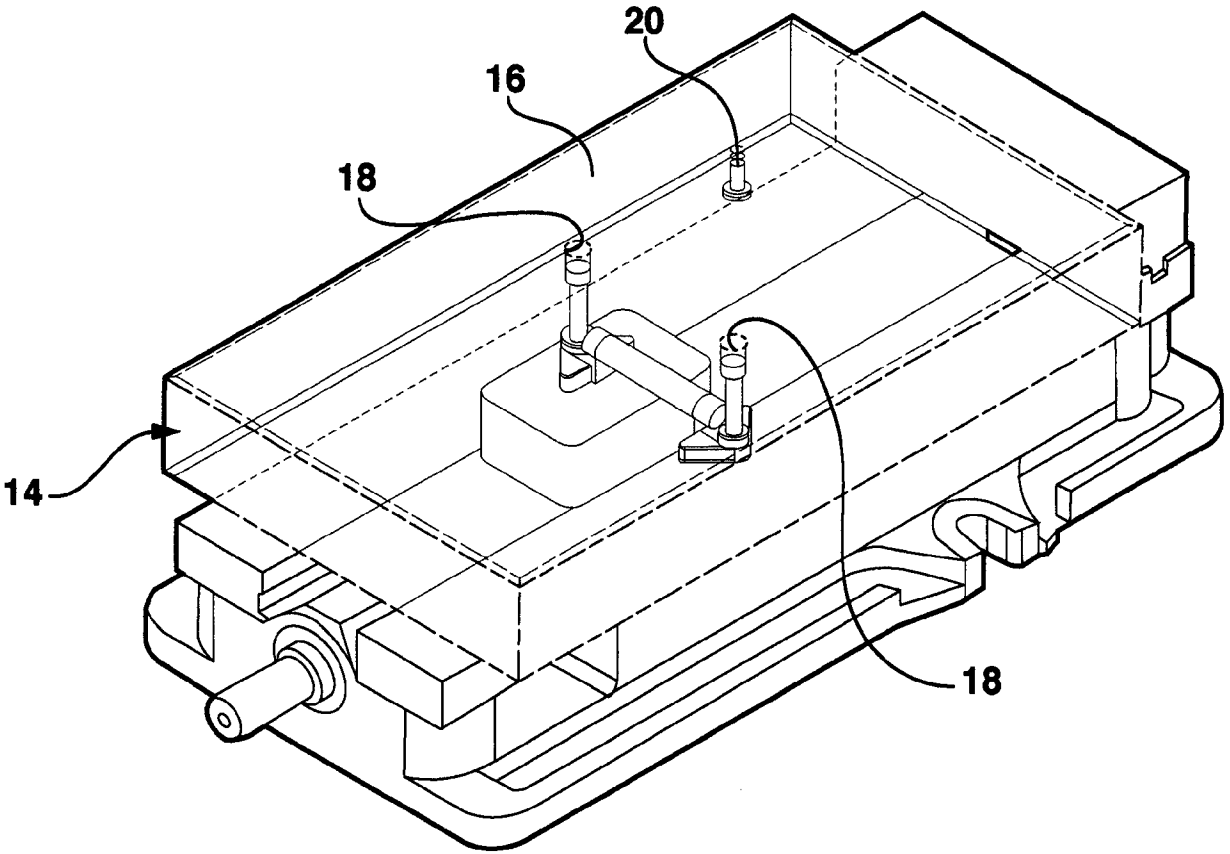
FIG. 2 is a phantom perspective view of a fixture plate shown in FIG. 1.
Figure 3:
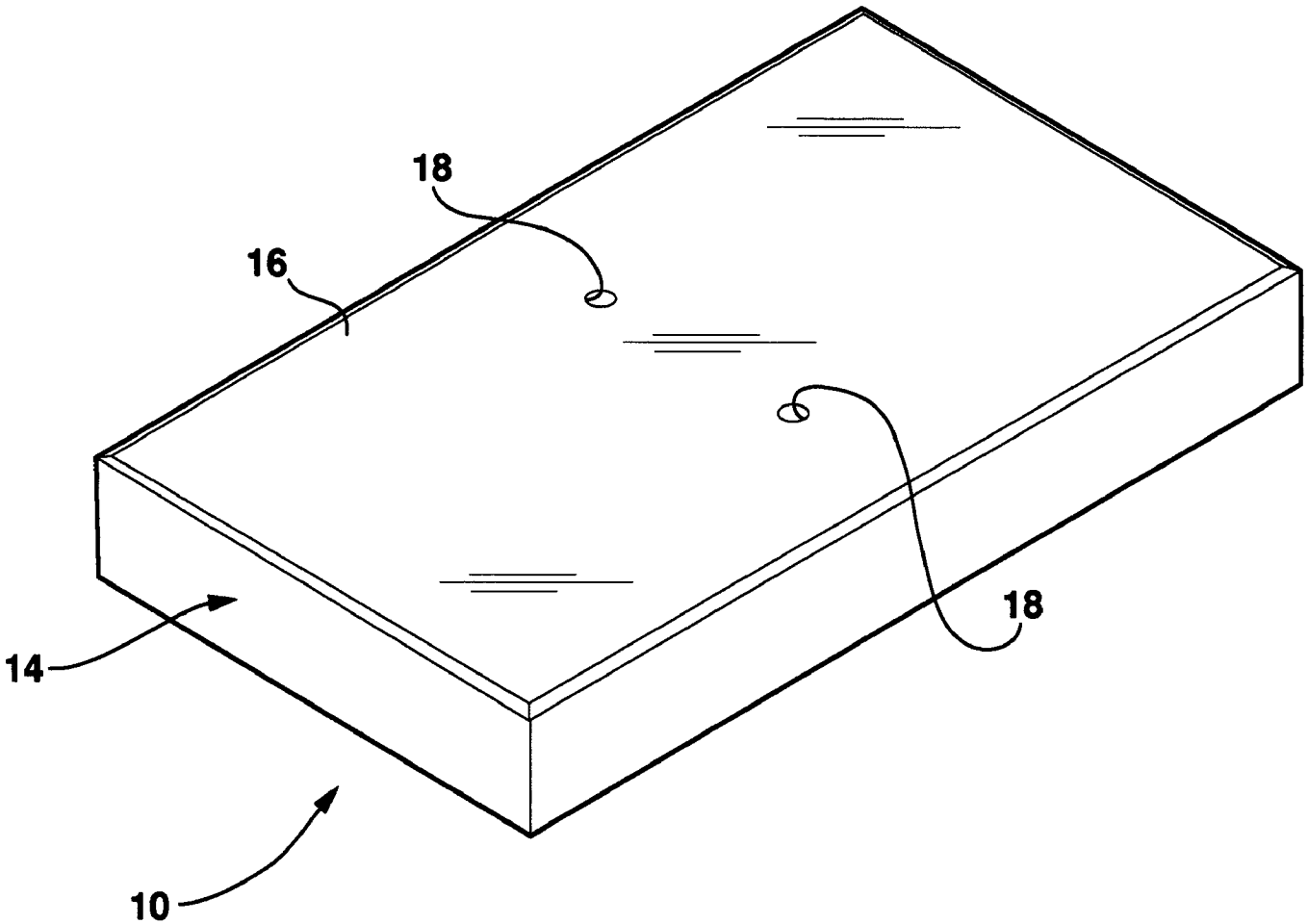
FIG. 3 is a perspective top view of a fixture plate according to the present invention.

A vise attachable fixture plate 10 is shown in FIG. 1 mounted on a conventional vise 12 of a conventional CNC milling machine. The vise attachable fixture plate 10 is constructed of a generally rectangular block 14 which in a preferred embodiment is constructed of aluminum. The block 14 has a top surface 16 which is provided with a pair of stepped through holes 18 as shown in FIG. 2

Figure 4:
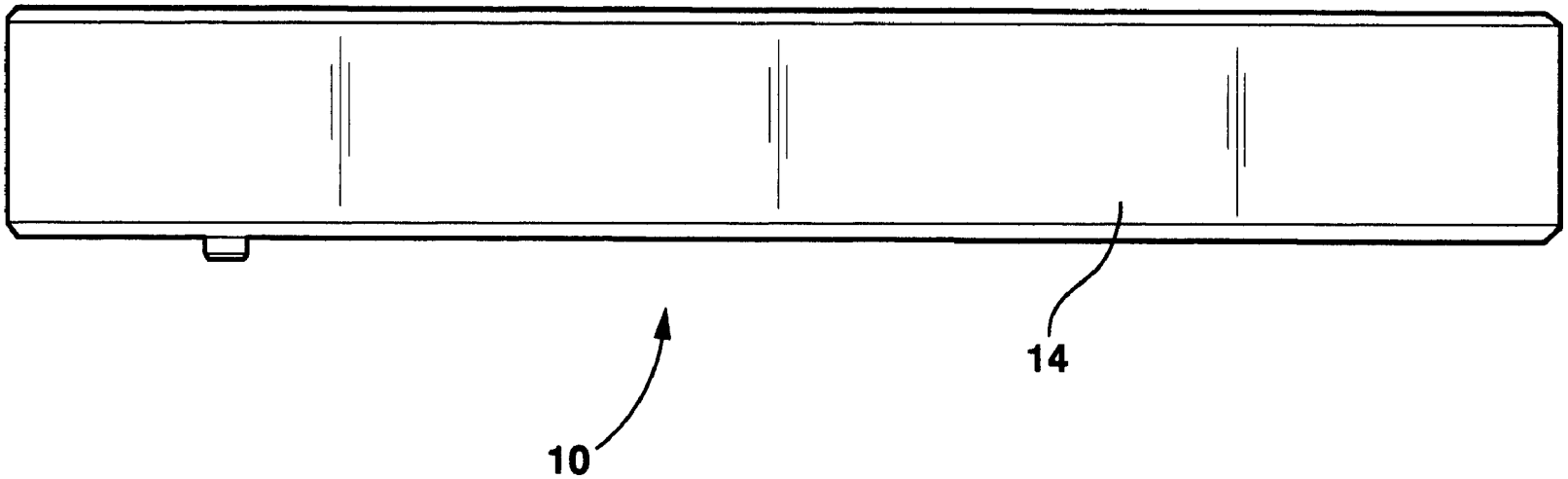
FIG. 4 is a left side elevational view of the fixture plate shown in FIG. 3.

A side view of the block 14 is shown in FIG. 4. An alignment stop 20 is mounted to the undersurface of the block 14 as shown in FIG. 4.

Figure 5:
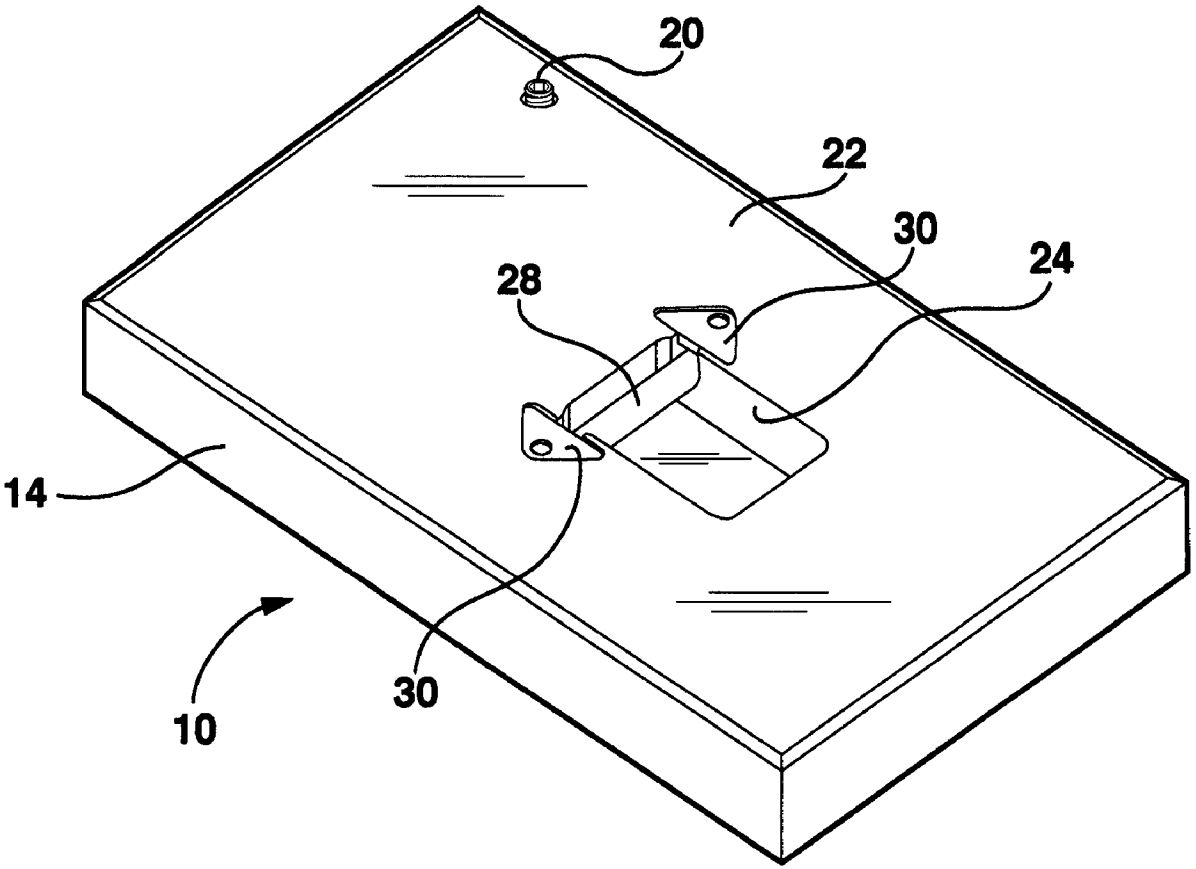
FIG. 5 is a bottom perspective view of the fixture plate shown in FIG. 3.

A bottom view of the block 14 is shown in FIG. 5. The block 14 includes a bottom surface 22 on which the alignment stop 20 is mounted as shown in FIG. 5. The bottom surface 22 is also provided with a clearance cavity 24 which opens into a pair of machined cavities 26 located on either side of the cavity 24 as shown in FIGS. 6 and 7.

Figure 6:
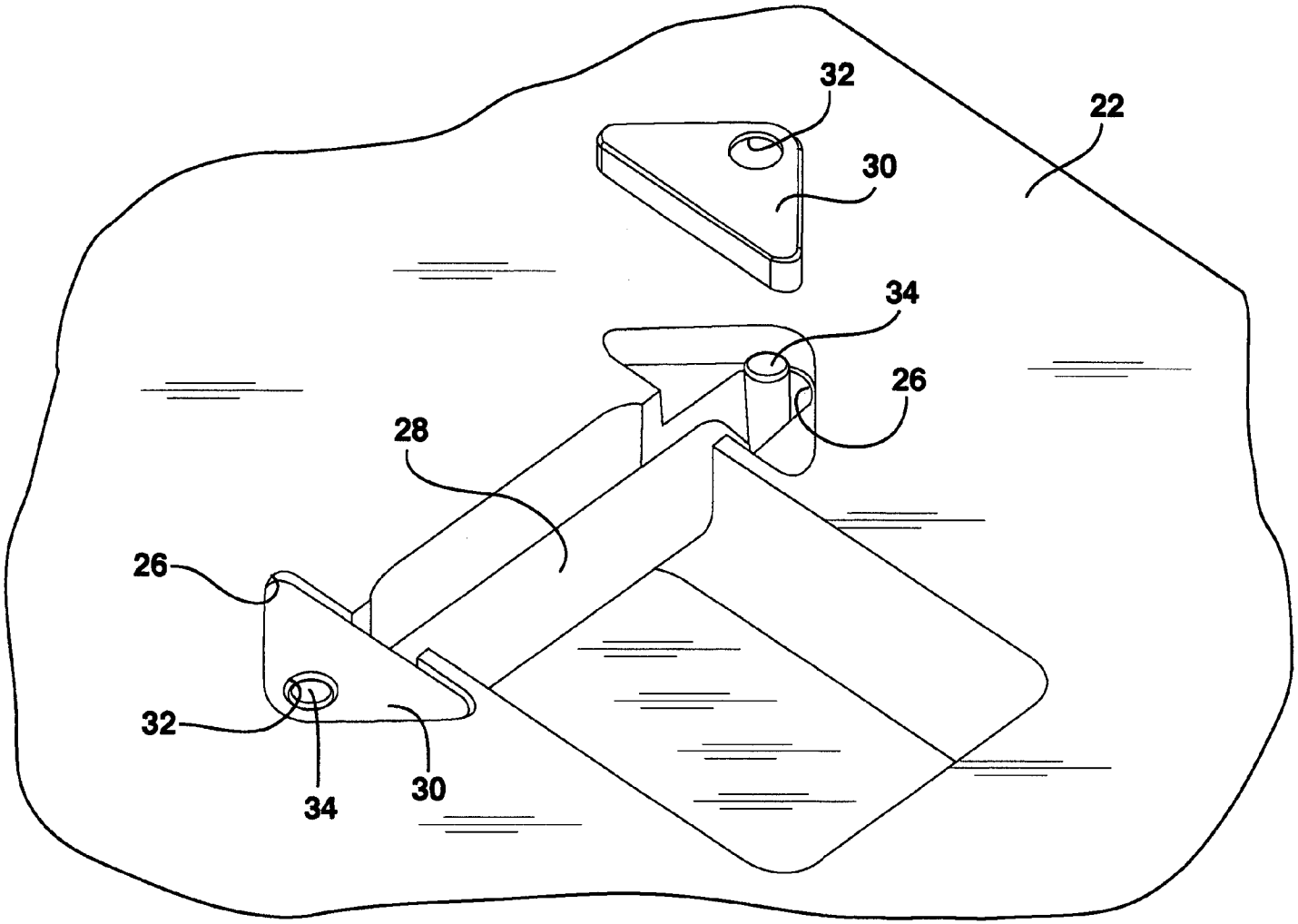
FIG. 6 is a detailed view of a portion of the fixture plate shown in FIG. 5.
Figure 7:
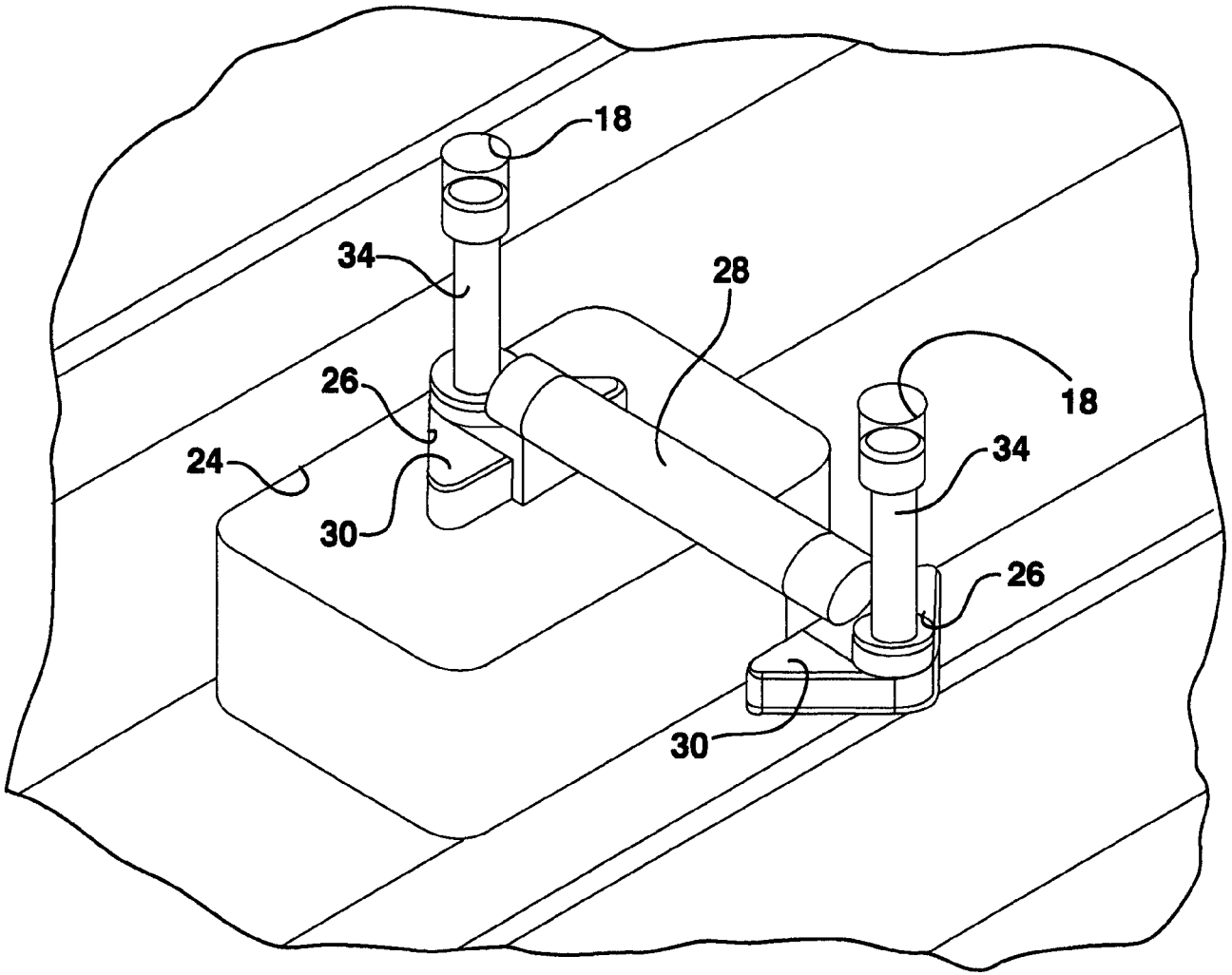
FIG. 7 is a detailed phantom view of the fixture plate shown in FIG. 2.

A clamping pin 28 is positioned to have its opposite ends resting in a respective cavity 26 as shown in FIG. 6. A pair of locking tabs 30 are positioned in the machined cavities 26 as shown in FIG. 6. The tabs 30 are shaped to be flush with the top surface of block 14. The locking tabs 30 are provided with a threaded bore 32 for readily receiving a step screw 34 which has been inserted through the through holes 18 as shown in FIG. 7. It is intended that the clamping pin 38 may be mounted to the block using other methods which may be easier to machine.

Figure 8:
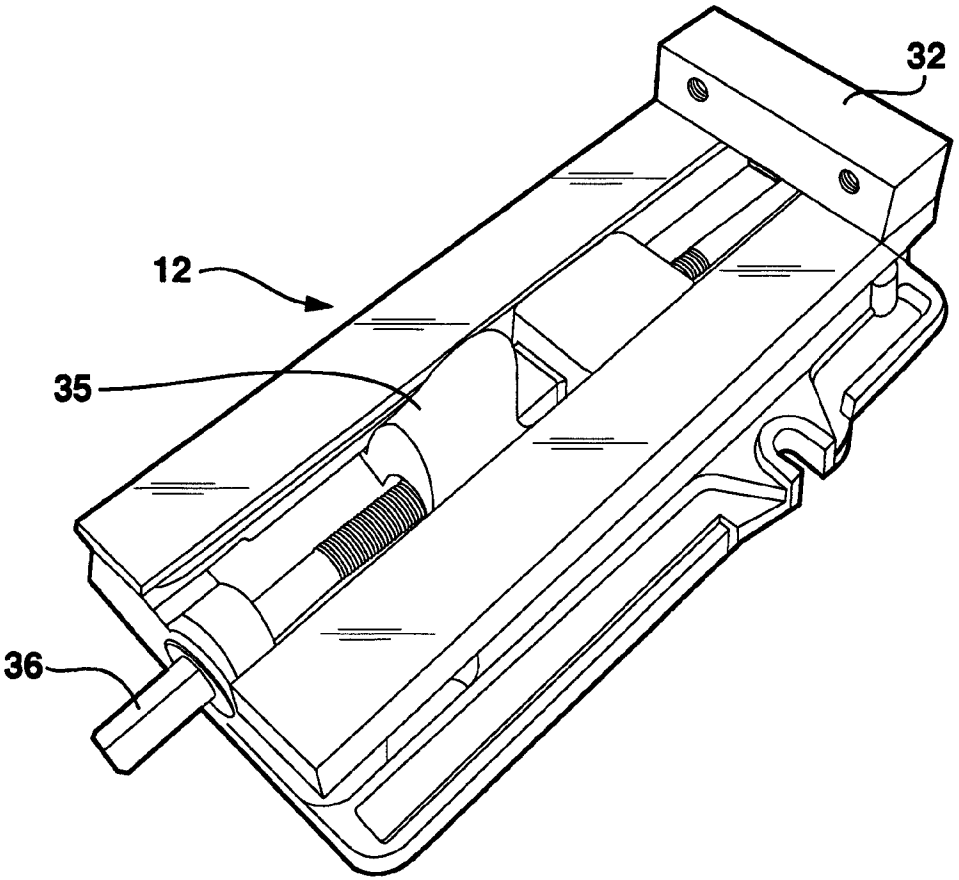
FIG. 8 is a perspective view of a conventional vise used with the present invention.

A conventional CNC machine vise 12 is shown in FIG. 8. The vise 12 includes a fixed jaw assembly 32 and a vise hook nut 35 which may be moved toward or away from fixed jaw assembly 32 with a machine screw 36.

In using the present invention, the block 14 is placed on top of the vise 12 and positioned with its forward end positioned against the fixed jaw assembly 32 and the alignment stop 20 resting against a side of the vise 12. The vise hook nut 35 is then manipulated so that it fits over the clamping pin 28. The machine screw 36 is then tightened in a normal manner to firmly clamp the block 14 onto the vise 12.

Figure 9:
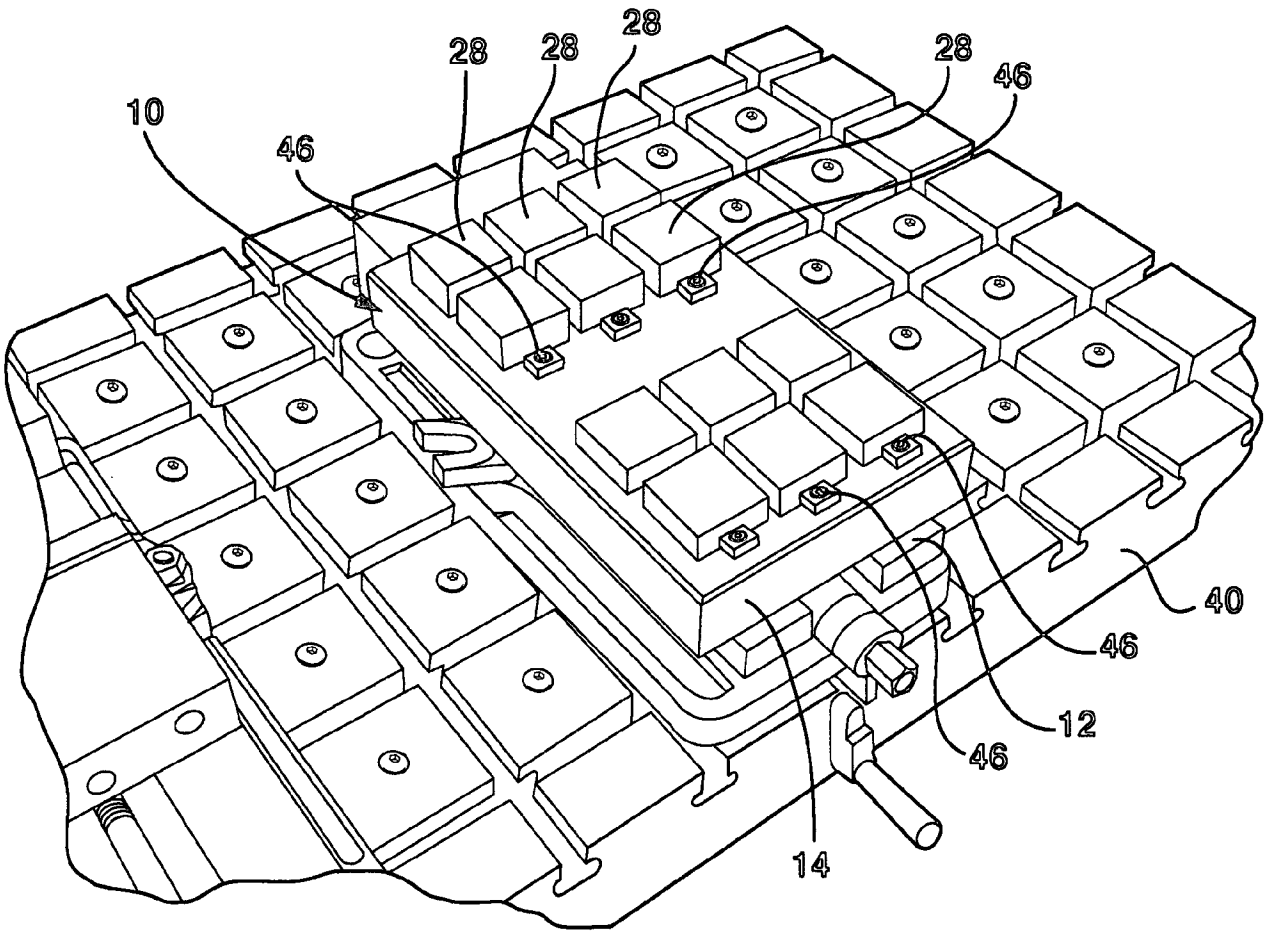
FIG. 9 is a perspective view of a fixture plate according to the present invention holding multiple workpieces for milling.
Figure 10:
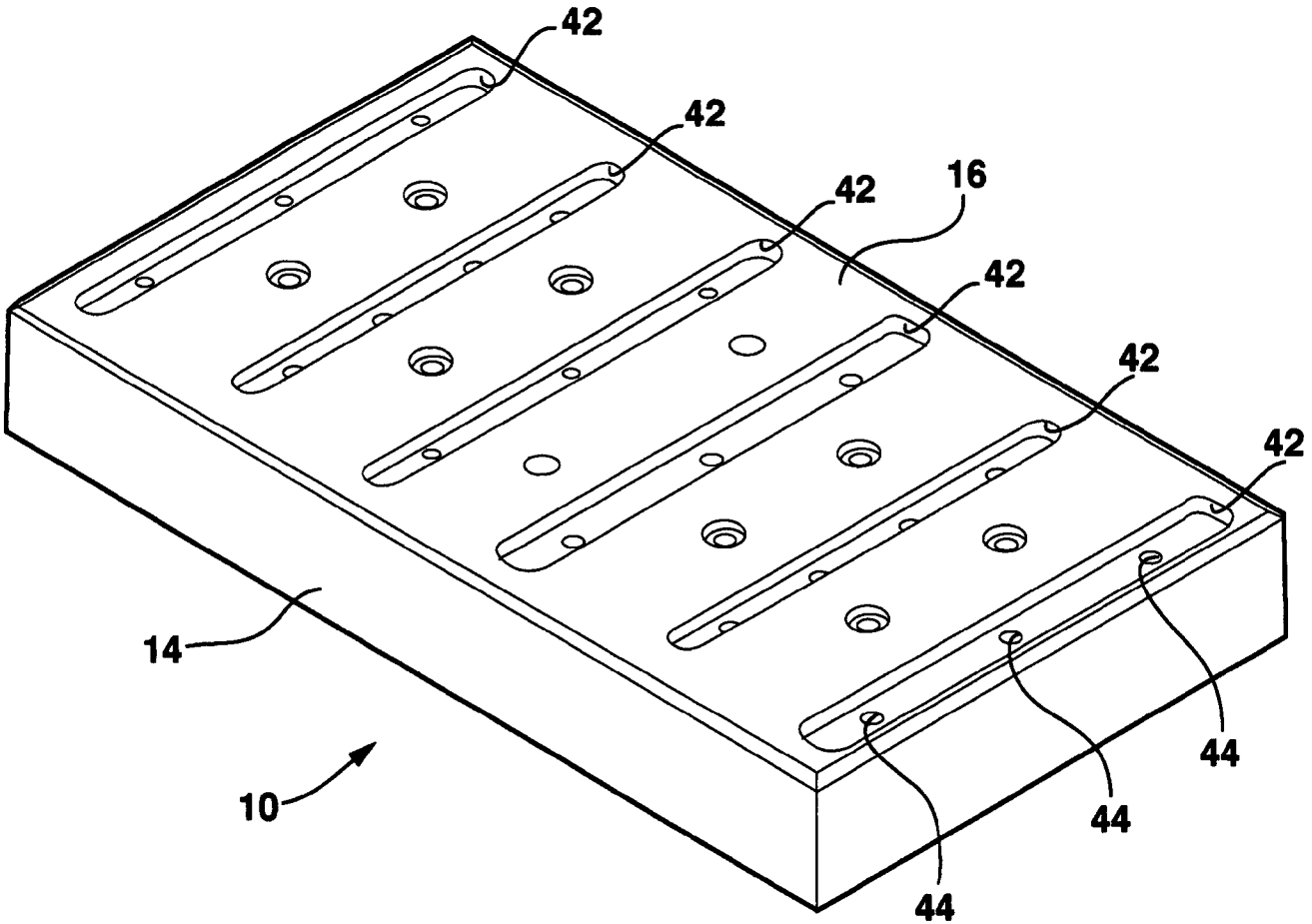
FIG. 10 is a perspective view of a top surface of the fixture plate showing the machined surfaces for holding the multiple workpieces shown in FIG. 9.

With the present invention, multiple working pieces may be secured to the block 14 for machining as shown in FIG. 9. In this figure, the conventional vise 12 is mounted on a working surface 40 of a conventional CNC milling machine. The top surface 16 of the block 14 can be machined in various patterns for securing the workpieces 28. FIG. 10 shows the top surface 16 machined for securing the workpieces 28 as shown in FIG. 9. Grooves 42 are machined in the top surface 16 and threaded holes are drilled in the grooves 42. The threaded holes 44 are used for accepting screws of a conventional clamping nut 46 as shown in FIG. 9 with the clamping nuts 46 recessed in grooves 42.

Figure 11:
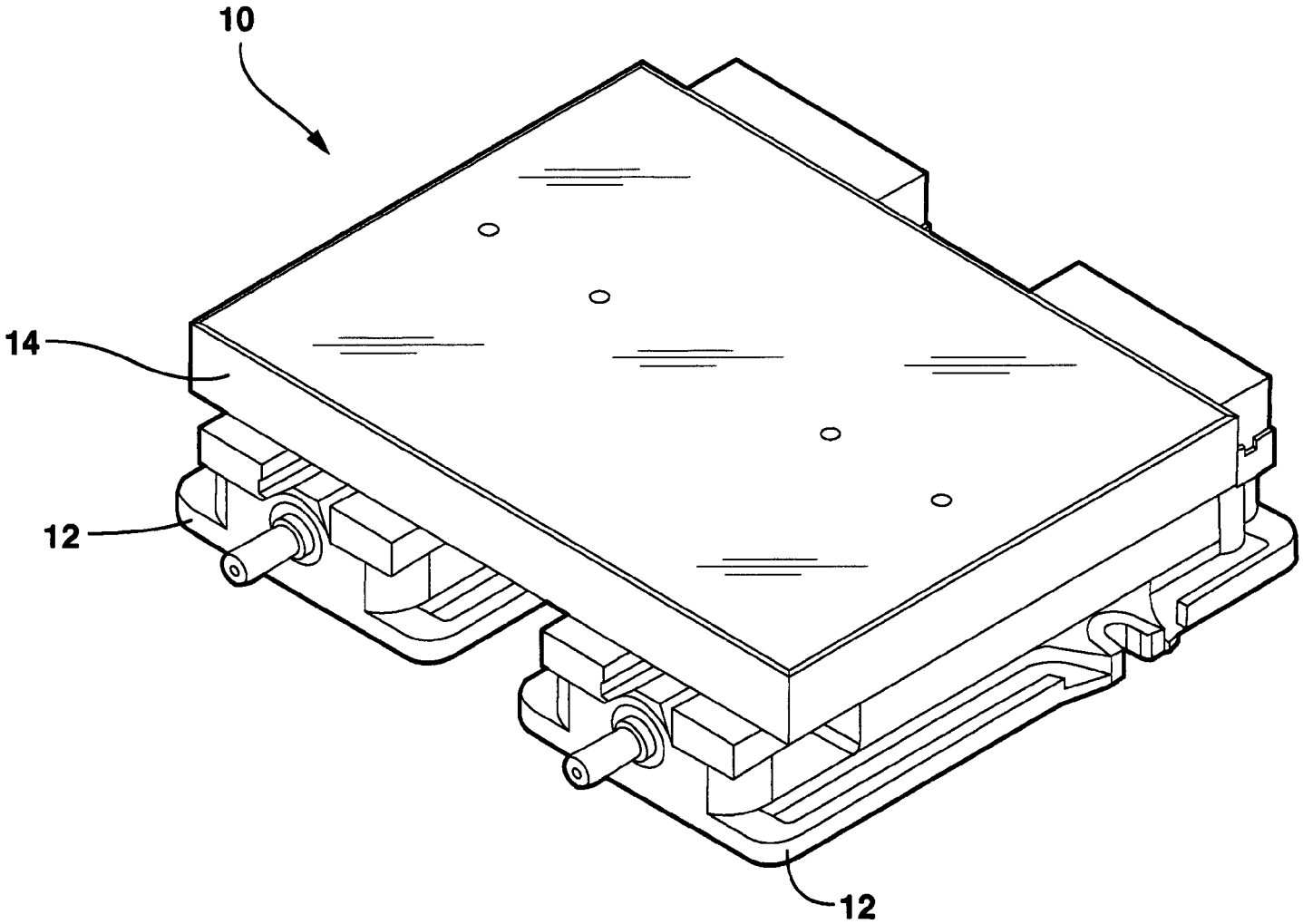
FIG. 11 is a perspective view of a fixture plate according to the present invention for use with a pair of vises used with conventional CNC milling equipment.

The present invention is very versatile. As shown in FIG. 11, the block 14 has been expanded in size to fit over a pair of vises 12 conventionally found in CNC milling equipment.

While the fundamental novel features of the invention have been shown and described, it should be understood that various substitutions, modifications, and variations may be made by those skilled in the arts, without departing from the spirit or scope of the invention. Accordingly, all such modifications or variations are included in the scope of the invention as defined by the following claims:

I claim:

1. A fixture plate for holding multiple work pieces in combination with a CNC milling machine having a vise with a support surface, a fixed jaw assembly, a vise hook nut threadably secured to a machine screw for moving the vise hook nut toward or away from the fixed jaw, the fixture plate comprising:

a generally rectangular block having a top surface, a bottom surface, a forward edge and a rearward edge;

the bottom surface of the block resting on the support surface of the vise with the forward edge of the block resting against the fixed jaw;

the bottom surface of the block having a cavity in which is mounted a clamping pin spanning the cavity for coupling with the vise hook nut, whereby when the machine screw is manipulated to move the mounting hook toward the fixed jaw, the block is clamped to the vise between the fixed jaw and the vise hook nut;

the top surface of the block provided with grooves shaped to conform to the peripheral shape of each of the multiple work pieces; and means recessed in the grooves for clamping the multiple work pieces to the block.

2. The fixture plate according to claim 1 further including an alignment pin mounted to the bottom surface of the block for aligning the block with the support surface of the vise.

* * * * *